US008091317B2

(12) United States Patent
Brackett

(10) Patent No.: US 8,091,317 B2
(45) Date of Patent: Jan. 10, 2012

(54) WIRE BOLT

(76) Inventor: Charles T. Brackett, Jacksonville, FL (US)

( * ) Notice: Subject to any disclaimer, the term of this patent is extended or adjusted under 35 U.S.C. 154(b) by 794 days.

(21) Appl. No.: 10/548,462

(22) PCT Filed: Mar. 1, 2004

(86) PCT No.: PCT/US2004/006280

§ 371 (c)(1),
(2), (4) Date: Sep. 1, 2005

(87) PCT Pub. No.: WO2004/079207

PCT Pub. Date: Sep. 16, 2004

(65) Prior Publication Data

US 2006/0265981 A1 Nov. 30, 2006

(51) Int. Cl.
*E04B 1/00* (2006.01)

(52) U.S. Cl. ..... 52/742.14; 52/223.6; 52/223.13; 52/223.14; 411/250; 411/389

(58) Field of Classification Search ..... 52/223.6, 52/223.142, 228, 514, 514.5, 742.1, 742.13, 52/742.16, 223.1–223.14; 411/250–252, 411/389, 392

See application file for complete search history.

(56) References Cited

U.S. PATENT DOCUMENTS

| | | | | | |
|---|---|---|---|---|---|
| 36,014 | A | * | 7/1862 | Meissner | 411/392 |
| 1,684,663 | A | | 9/1928 | Dill | |
| 2,921,463 | A | * | 1/1960 | Goldfein | 52/223.13 |
| 2,971,295 | A | * | 2/1961 | Reynolds | 52/223.7 |
| 3,195,277 | A | * | 7/1965 | Greulich | 52/223.6 |
| 3,347,005 | A | * | 10/1967 | Preston, Jr. | 52/223.14 |
| 3,478,396 | A | * | 11/1969 | Drouillard | 403/371 |
| 3,590,474 | A | | 7/1971 | Beghi | 29/452 |
| 3,676,968 | A | * | 7/1972 | Campbell | 52/223.6 |
| 3,701,509 | A | | 10/1972 | Stinton | 254/29 A |
| 3,820,832 | A | | 6/1974 | Brandestini et al. | 287/80 |
| 3,844,697 | A | | 10/1974 | Edwards | 425/111 |
| 3,922,437 | A | | 11/1975 | Kitta et al. | 428/383 |
| 4,080,765 | A | | 3/1978 | Fasano | 52/228 |
| 4,094,222 | A | * | 6/1978 | Lang et al. | 411/15 |
| 4,441,289 | A | | 4/1984 | Ikuo et al. | 52/167 |
| 4,445,321 | A | | 5/1984 | Hutchinson | 57/223 |
| 4,563,870 | A | | 1/1986 | Lucht | 57/223 |
| 5,056,284 | A | | 10/1991 | Ruckdeschel et al. | 52/230 |
| 5,149,385 | A | | 9/1992 | Kurauchi et al. | 156/85 |
| 5,170,606 | A | * | 12/1992 | Popp | 52/707 |
| 5,209,987 | A | | 5/1993 | Penneck et al. | 428/610 |
| RE34,350 | E | | 8/1993 | Dufossez | 52/146 |
| 5,490,365 | A | | 2/1996 | Roth | 52/704 |
| 5,517,793 | A | | 5/1996 | Flores et al. | 52/167.1 |
| 5,569,007 | A | | 10/1996 | Abraham | 411/82 |
| 5,630,301 | A | | 5/1997 | Sieg | 52/223.13 |
| 5,983,473 | A | | 11/1999 | Yuguchi et al. | 29/33 F |
| 6,014,843 | A | * | 1/2000 | Crumley et al. | 52/167.3 |

(Continued)

*Primary Examiner* — William V Gilbert
(74) *Attorney, Agent, or Firm* — Schmid PA

(57) ABSTRACT

A wire bolt comprising an elongated section of wire rope with a section of threaded stud attached to each end is disclosed for use in reinforcing concrete structures. Part of the wire rope portion is coated with a substance to prevent that portion from bonding with the concrete. The threaded rod portion can be attached within the concrete by epoxy or attached to the concrete by appropriate mechanical means. The wire bolt can be attached to a concrete building structure during initial construction of a structure or retrofit into existing structures. Wire bolts should be installed in areas susceptible to shear or bending failure and serve to prevent the concrete sections from separating in a seismic event.

15 Claims, 7 Drawing Sheets

U.S. PATENT DOCUMENTS

| | | | | |
|---|---|---|---|---|
| 6,102,607 | A | 8/2000 | Kintscher | 403/291 |
| 6,185,886 | B1 | 2/2001 | Gruen et al. | 52/223.13 |
| 6,216,403 | B1 | 4/2001 | Belbeoc'h | 52/223.13 |
| 6,224,036 | B1 | 5/2001 | Prince et al. | 254/29 A |
| 6,374,551 | B1 | 4/2002 | Boilen et al. | 52/167.3 |
| 6,399,021 | B1 | 6/2002 | Heimann et al. | 422/7 |
| 6,645,319 | B2 | 11/2003 | Nagao et al. | 148/330 |
| 6,711,866 | B2 | 3/2004 | Blount | 52/649.1 |
| 6,911,077 | B2 | 6/2005 | Zucker | 106/644 |
| 2004/0065030 | A1* | 4/2004 | Zambelli et al. | 52/223.13 |

* cited by examiner

FLOOR SLAB TO CMU TIE BEAM

WIRE BOLT

TECHNICAL FIELD

This invention relates generally to reinforcements for building structures, and more particularly to structures in seismic regions where building codes dictate that these structures be protected against structural failure and/or to save lives of occupants. In particular, the present invention relates to a wire bolt system for reinforcing structures to increase their ability to withstand seismic forces. The wire bolt system can be installed in new structures or retrofit into existing structures. The present invention also relates to a wire bolt system that provides additional reinforcements for an existing structure.

BACKGROUND ART

Concrete and other similar substances have been known and used for many years. However, no matter how much care is taken in the preparation or placement of concrete and concrete-like structures, cracks, voids, and fissures can develop causing various problems. The problem of cracking or of defective joints in concrete structures is a source of concern. In particular, when a concrete structure is subjected to tremendous forces, such as during an earthquake, large cracks and even total failure of the structure can result.

The reinforcement of preexisting structures comprising concrete such as buildings, bridge columns, piers, bridges, and the like by the use of a sheet material, in which high strength fibers are affixed to the structures with resin or other filler material, and then left to cure, is generally known.

Furthermore, other reinforcement methods are also known. For example, U.S. Pat. No. 6,308,478 to Kintscher et al. describes a construction method wherein wire rope is embedded in the structure alongside metal reinforcing bars so that adjacent components can be connected together.

U.S. Pat. No. 6,634,830 to Marshall describes a method for post tensioning wire rope to repair concrete pilings.

DISCLOSURE OF INVENTION

Connections between concrete members and attachments to them of other materials for structures located in seismic regions have resulted into a major new area of structural design. This invention focuses on the use of wire rope with or without end attachments placed in new or retrofitted into existing concrete structural members. The wire bolt provides an additional level of structural redundancy in areas of concrete members where failure is caused by a seismic event. The invention is applicable to both new design and construction and for retrofitting into existing structures.

The wire bolt disclosed herein can be used in addition to current seismic design procedures, except to be used in addition to them. The wire bolt will remain attached after the concrete has failed and the steel rebar bond has been broken and failed in tension and shear. The wire bolt is designed to remain elastic throughout any seismic event, maintain its bond with the concrete, and hold the structure together long enough at least to provide a much higher degree of life safety for occupants than existing design and construction methods.

It is an object of the present invention to provide a wire bolt for use in a structure of a new building that reinforces the structure against damage in a seismic event, such as an earthquake.

It is a further object of the present invention to enable installation of a wire bolt system after the building is complete.

It is another object of the present invention to provide a wire bolt system for a concrete building that provides reinforcement to the floors and support structure, thereby providing greater resistance to damage during a seismic event.

BRIEF DESCRIPTION OF THE DRAWINGS

The above and other features, aspects, and advantages of the present invention are considered in more detail, in relation to the following description of embodiments thereof shown in the accompanying drawings, in which.

BEST MODE(S) FOR CARRYING OUT THE INVENTION

Figure 1:
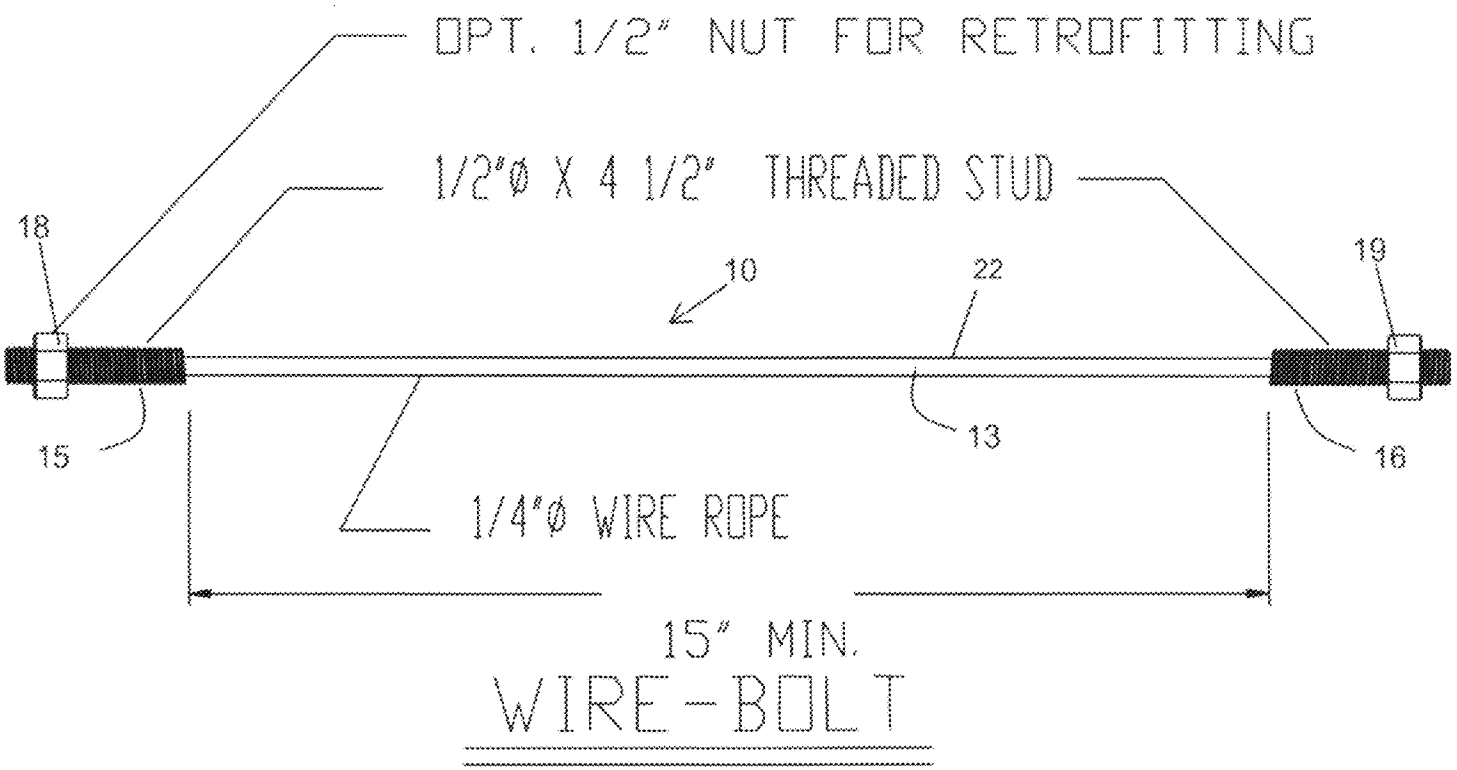
FIG. 1 shows a wire bolt embodiment according to the present invention.

Referring to FIG. 1, a wire bolt design consistent with the present invention is illustrated. Such wire bolt, indicated generally as 10, consists of a section of wire rope 13 with a solid steel attachment 15, 16 swaged to each end. As shown in FIG. 1, attachments 15, 16 may be solid plain or threaded short sections of steel that are attached to each end of wire rope 13 to form the wire bolt 10. The attachments 15, 16 are usually attached to the wire rope by cold forming of metal called swaging, which is known in the art. Other methods of attaching may be used. The embodiment shown in FIG. 1 includes a ¼-inch ϕ wire rope portion 13 at least fifteen inches long, having a ½-inch ϕ threaded attachment 15, 16 approximately 4½-inches long. Optionally, the attachment portions 15, 16 may include an appropriately sized nut 18, 19 threaded thereon. In a preferred embodiment, the wire rope portion 13 is coated with a substance 22 to prevent that portion from bonding with concrete.

Figure 3:
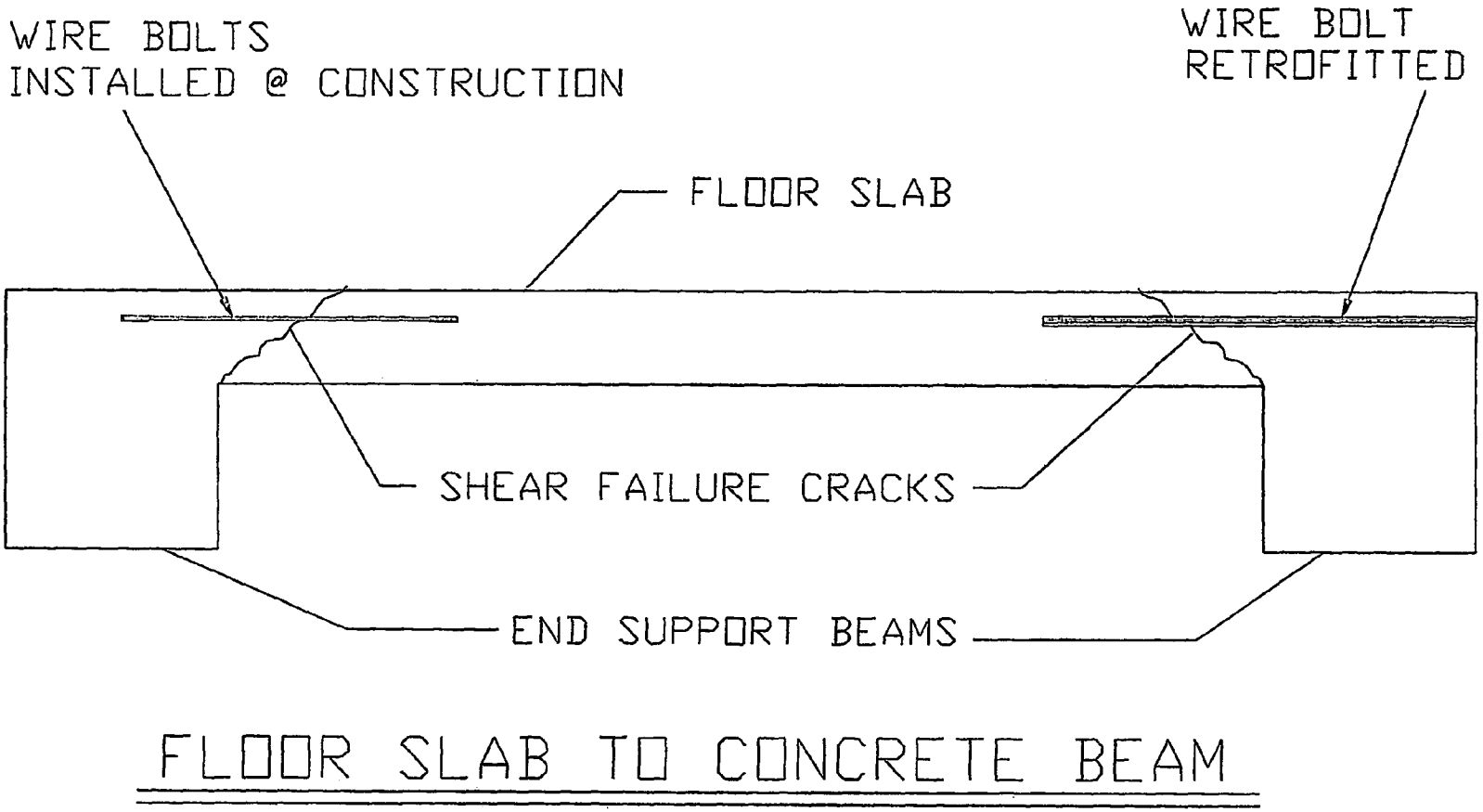
FIG. 3 shows a floor slab reinforcement according to the present invention.
Figure 4:
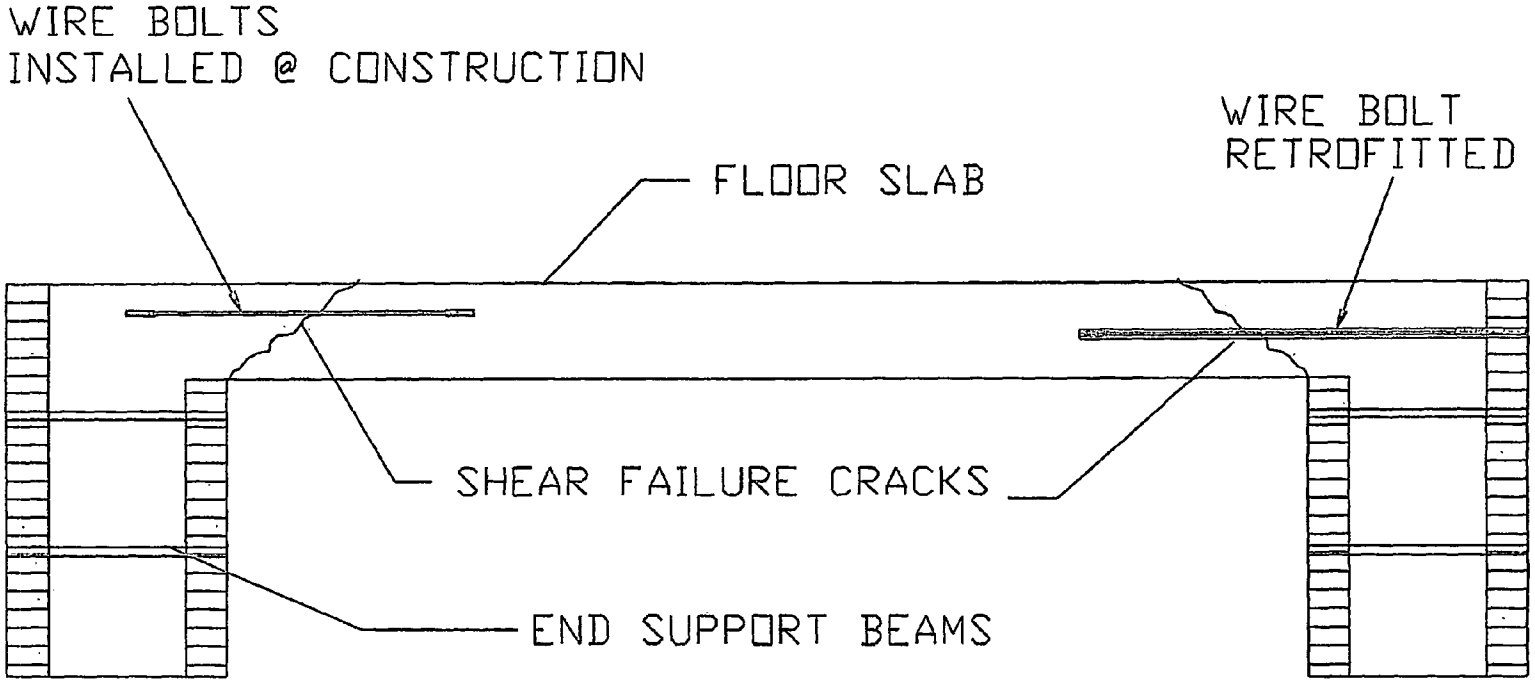
FIG. 4 shows an alternative floor slab reinforcement according to the present inventions.

Wire bolt 10 can be used in a variety of applications, such as shown in the Figures. The wire bolt can be installed during initial construction at locations susceptible to failure such as near the bottom of a concrete floor slab where cracks might form due to bending, or near the support columns where shear stresses may cause cracking, see FIG. 6. The wire bolt can also be retrofitted to existing structures. For retrofitting, a socket is formed from external of the concrete beam or column, as shown in FIGS. 3 and 4. Such socket should be deep enough to extend sufficiently beyond the failure zone. Epoxy, or other suitable adhesive is injected into the socket and a wire bolt is inserted, see FIG. 7. The wire bolt should be sufficient length to extend to the end of the socket while leaving sufficient threaded portion exposed to attach a nut to the threaded portion. As is known in the art, a metal plate may be installed with the nut to provide a firm seating surface. Such metal plate can be left flush with the edge of the concrete. The metal plate can be fixed in place by a suitable adhesive, such as epoxy and the like.

There are several sizes of stranded wire rope cable that can be used in the present invention, as shown in Table 1. Wire Rope has two kinds of stretch within its elastic limit. These are its elastic and constructional stretch and both must be considered in design.

TABLE 1

Wire Rope Capacities

| Diameter (in) | Nominal Strength (tons) |
|---|---|
| 3/16 | 2.14 |
| 1/4 | 3.77 |
| 5/16 | 5.86 |
| 3/8 | 8.39 |
| 1/2 | 14.8 |
| 9/16 | 18.6 |
| 5/8 | 22.9 |
| 3/4 | 32.7 |
| 7/8 | 44.3 |
| 1" | 57.5 |

Elastic stretch is the temporary elongation of the wire rope that occurs while under load. The wire rope if kept below its elastic limit of about 60% of its ultimate breaking strength will return to its normal length.

The elastic stretch is proportional to the load times the length of wire rope and inversely proportional by its modulus of elasticity and area. The equation used to calculate elastic stretch is as follows:

$$\Delta L = \frac{\Delta P \times L}{A \times E}$$

ΔL=Change of overall length
ΔP=Change in load on rope
L=Length of rope
A=Metalic area of rope
E=Modulus of elasticity Constructional stretch is a permanent elongation of the wire rope. This permanent stretch starts immediately when the load is applied. This is caused by the strands adjusting themselves into the small voids between the strands and their seating onto the core. The normal length of constructional stretch is approximately ½% of the length of rope under load. The constructional stretch for short segments of wire can be removed in two ways, pre-stretching and post tensioning. Pre-stretching the load should be equal to or greater than the working load but must not exceed the elastic limit. Post tensioning is performed at installation of the wire bolt during construction and is used only in the wire bolt to pre-stretch the wire rope portion, which is then released to post-tension.

A wire bolt as taught herein can be installed in new or existing concrete in a variety of applications. The embedded attachments behavior will follow the same requirement as any bonded or grouted anchor with their strength dependant on embedment, edge distance spacing and type of material embedded in. The attachments of short sections of allthread (A-36) steel rods have strength based on size and embedment. The strength of epoxy embedded threaded stud in tension has been tested and documented by many sources and on average are close to the same capacity provided here in Table 2 for embedment in 4000 psi concrete.

TABLE 2

Threaded Attachments

| Rod Size | Embedment | Capacity |
|---|---|---|
| 3/8 | 4½" | 2,835 # |
| 1/2 | 4½" | 4,360 # |
| 5/8 | 5⅝" | 7,545 # |
| 3/4 | 6¾" | 9,735 # |
| 7/8 | 7⅞" | 10,595 # |
| 1" | 9" | 14,890 # |

A wire bolt that is pres-stretched can be installed by embedment in the concrete during new construction or embedded in epoxy in pre-drilled holes in existing concrete. A part of the wire rope portion of such wire bolt should be coated to prevent bonding to the concrete in order to allow the elastic properties of the wire to move during an earthquake.

Figure 2:
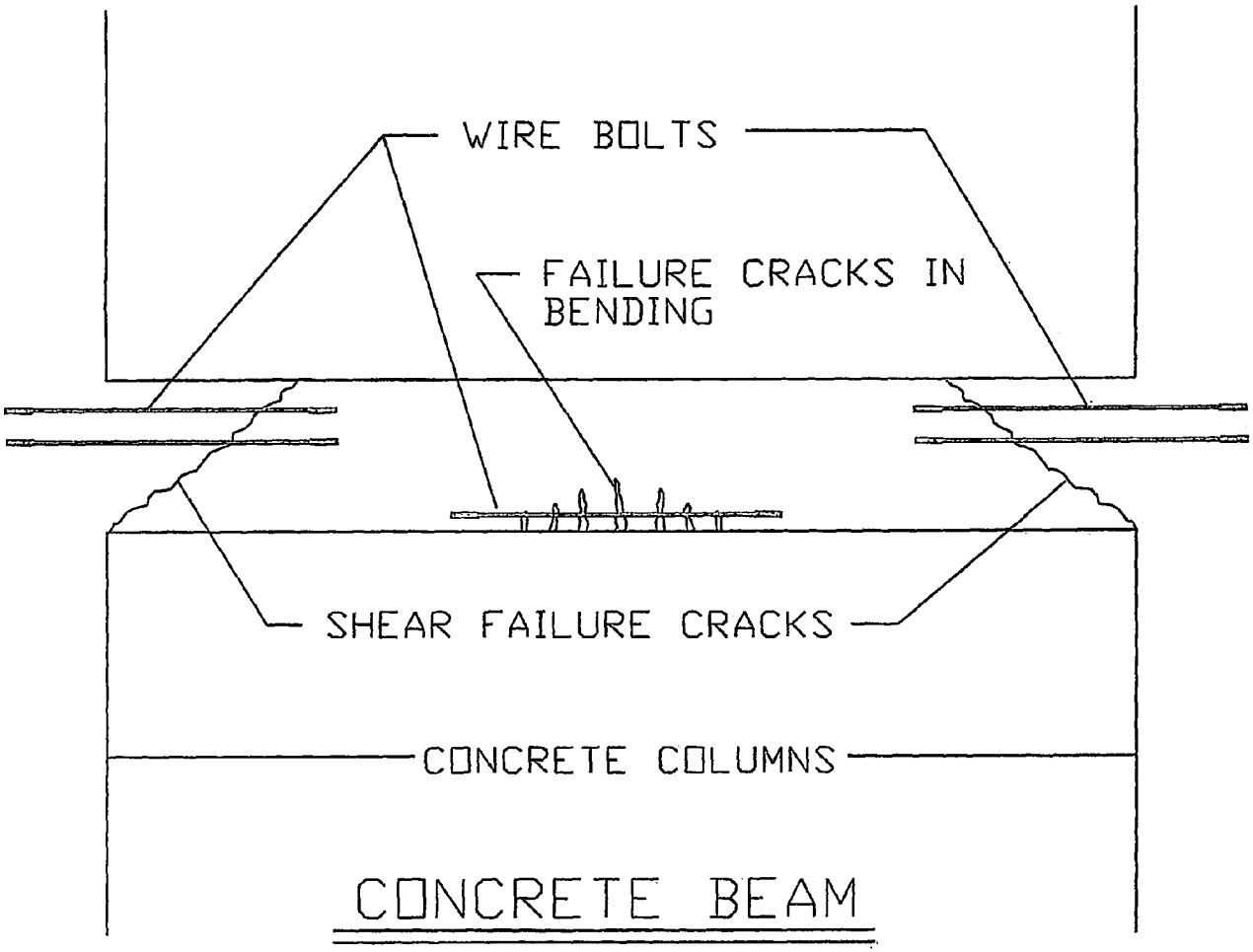
FIG. 2 shows a wire bolt used as a concrete beam reinforcement according to the present invention.

In one embodiment, a wire bolt is placed across the normal shear and bending failure zones in concrete beams and their connection to support columns, as shown in FIG. 2.

In a second embodiment, a wire bolt is installed along a concrete floor slab where it attaches to main support beams, as shown in FIG. 3.

In another embodiment, a wire bolt is used to tie a floor slab to a CMU wall, as shown in FIG. 4.

Figure 5:
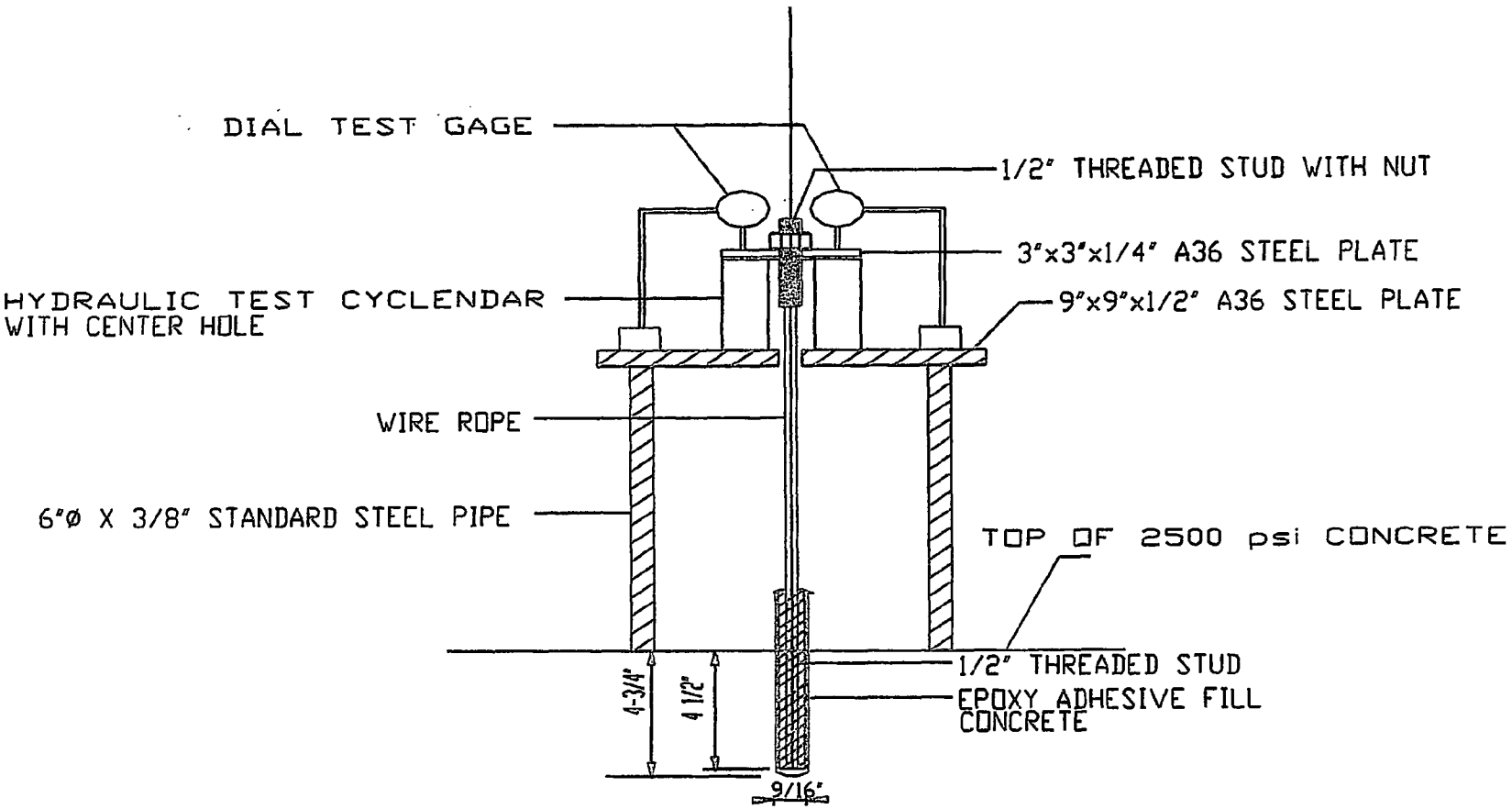
FIG. 5 shows a test device used to verify the present inventions.
Figure 8:
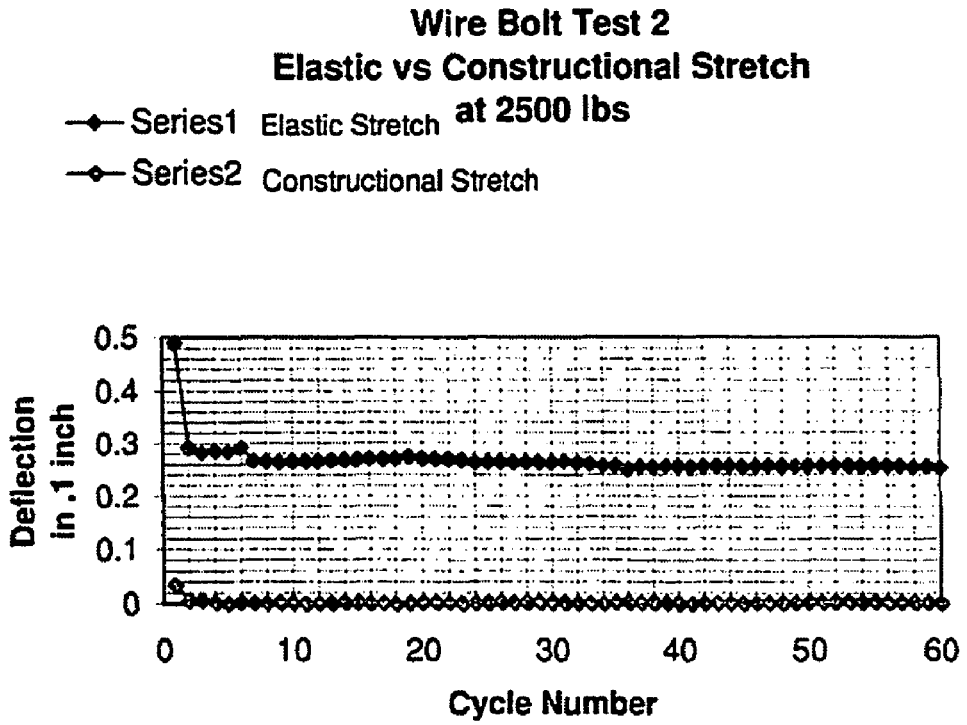
FIG. 8 depicts a chart illustrating the elastic stretch verses the constructional stretch noticing the deflection and number of cycles.
Figure 9:
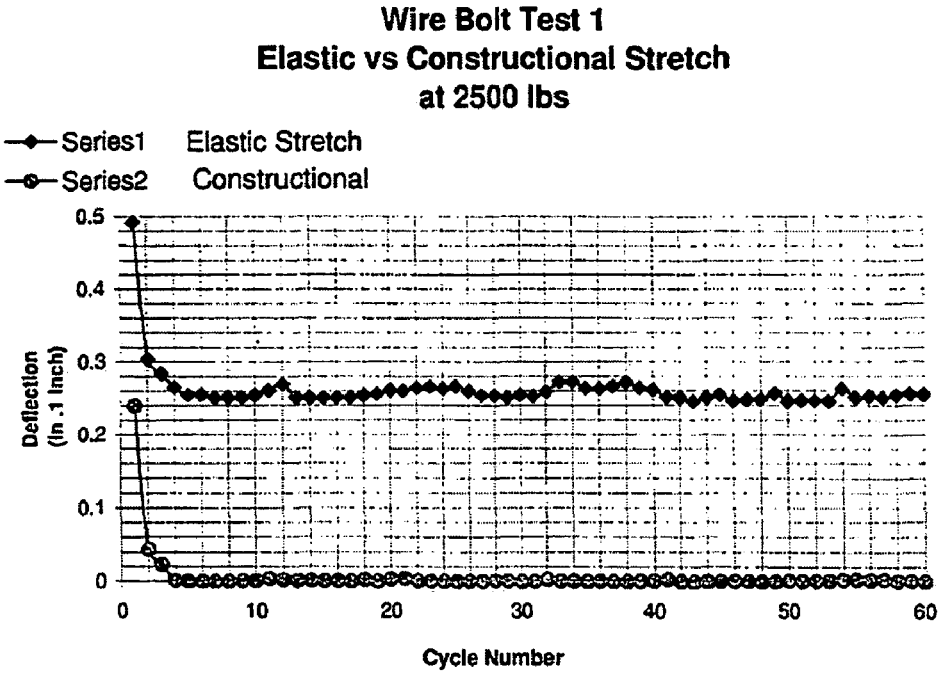
FIG. 9 is a further chart illustrating the elastic stretch verses the constructional stretch noticing the deflection and number of cycles.

A series of tests was performed to determine if a wire bolt, when post installed in existing concrete, could withstand the forces associated with a seismic event. A test stand as shown in FIG. 5 applied cyclic loading to simulate the effects of an earthquake in order to determine if the construction stretch is eliminated and if the wire bolt will return to normal or its original position. If so, this would prove the ability of such wire bolt to hold two sections of concrete together after normal failure of the concrete and steel.

The test was conducted to determine what, if any, permanent deformation or stretch would result from a seismic event. Using the test stand shown in FIG. 5, tests were performed on wire bolts embedded into concrete on one end with the other end attached to a hydraulic test cylinder. The same load of 2500 lbs. was applied and then returned to zero 60 times to simulate a cyclic load of an earthquake. The deformation was recorded each time at maximum load and the permanent deformation, if any, was recorded after returning to 0# load.

In both Test 1 and Test 2, elongation of the wire bolt was 80% completed after only two cycles' of 2500 psi. Elongation was approximately 99% at the 3$^{rd}$ cycle. The elastic stretch went from 0.49" and 0.48" to approximately 0.3" in one cycle, and then averaged only 0.25" after the 3$^{rd}$ cycle. This indicates that after a concrete and steel failure the wire bolt will only allow a separation of ¼" during each cycle. This test also proves that the epoxy connection will not fail under a cyclic load of 2500 psi for the size of wire bolt. Therefore, wire bolts should be pre-stretched to eliminate the initial constructional permanent stretch.

All of the factors will change with different lengths and sizes of wire rope and threaded studs. The results can be predicated based on the methods presented.

INDUSTRIAL APPLICABILITY

The wire bolt provides an additional redundant load path for concrete structures and helps to prevent loss of life. The test demonstrated that elastic stretch was achieved after a permanent deformation in the wire bolt and would return to zero after each cycle. It is proposed that it be used in both new construction and in existing structures by retrofitting them by drilling and epoxying them in place.

What is claimed is:

1. A method for reinforcing a structure for a seismic event, such method comprising:

furnishing a wire bolt, comprising:

a first end section comprising a first elongated solid attachment;

a second end section comprising a second elongated solid attachment; and a middle section comprising an elongated section of wire rope substantially lacking constructional stretch and the wire rope having an elasticity and the rope having a plurality of wire strands and a first end and a second end, the first end and second end of the wire rope attached to the first and second solid attachments respectively, the wire rope terminating at the attachment point to the elongated solid attachments; and drilling a socket in the concrete;

injecting an adhesive into said socket;

coating at least a portion of said wire bolt with a substance to prevent the wire rope from bonding with said concrete and said adhesive; and inserting the wire bolt in the socket and embedding both elongated solid attachment in said adhesive.

2. The method of claim 1 wherein at least a portion of either or both said first and second elongated solid attachment is threaded.

3. The method of claim 2 wherein said fastener comprises a nut.

4. A wire bolt comprising:

a first end section comprising a first elongated solid attachment;

a second end section comprising a second elongated solid attachment; and a middle section comprising an elongated section of wire rope substantially lacking constructional stretch and the wire rope having an elasticity and the rope having a plurality of wire strands and a first end and a second end, the first end and second end of the wire rope attached to the first and second solid attachments respectively, the wire rope terminating at the attachment point to the elongated solid attachments; and at least a portion of the wire rope is coated with a substance to prevent the wire rope from bonding with the concrete.

5. The wire bolt of claim 4 wherein at least a portion of either or both said first and second elongated solid attachment is threaded.

6. The wire bolt of claim 5, further comprising a nut attached to said threaded portion of either or both said first and second elongated solid attachment.

7. The wire bolt of claim 4 wherein either or both said first and second elongated solid attachment is connected to said wire rope by cold forming.

8. The wire bolt of claim 4 wherein either or both said first and second elongated solid attachment is connected to said wire rope by swaging.

9. A method for reinforcing a structure for a seismic event, such method comprising: furnishing a wire bolt, comprising:

a first end section comprising a first elongated solid attachment;

a second end section comprising a second elongated solid attachment; and a middle section comprising an elongated section of wire rope substantially lacking constructional stretch and the wire rope having an elasticity and the rope having a plurality of wire strands and a first end and a second end, the first end and second end of the wire rope attached to the first and second solid attachments respectively, the wire rope terminating at the attachment point to the elongated solid attachments; and coating at least a portion of said wire bolt with a substance to prevent the wire rope from bonding with said concrete;

embedding said first and second elongated solid attachments in said concrete; and allowing said adhesive to cure within said concrete.

10. The method of claim 9 wherein at least a portion of either or both said first and second elongated solid attachment is threaded.

11. A concrete structure, comprising:

a body of concrete having a wire bolt embedded therein, said wire bolt comprising a first end section comprising a first elongated solid attachment;

a second end section comprising a second elongated solid attachment; and a middle section comprising an elongated section of wire rope substantially lacking constructional stretch and the wire rope having an elasticity and the rope having a plurality of wire strands and a first end and a second end, the first end and second end of the wire rope attached to the first and second solid attachments respectively, the wire rope terminating at the attachment point to the elongated solid attachments; and at least a portion of said wire rope is coated with a substance to prevent the wire rope from bonding with said body of concrete.

12. The concrete structure of claim 11 wherein at least a portion of either or both said first and second elongated solid attachment is threaded.

13. The concrete structure of claim 11 wherein said wire bolt is placed in said concrete body at a location susceptible to failure.

14. The concrete structure of claim 13 wherein said wire bolt is placed in a failure zone of said concrete body.

15. The concrete structure of claim 13 wherein said wire bolt is placed across a shear zone of failure of said concrete body.

* * * * *